United States Patent [19]

Mokris

[11] 4,325,495

[45] Apr. 20, 1982

[54] STORAGE BIN ACTIVATOR DEVICE AND METHOD FOR RESTORING BULK MATERIAL FREE FLOW

[75] Inventor: Michael M. Mokris, Lakewood, N.J.

[73] Assignee: Pulsonics Corporation, Lakewood, N.J.

[21] Appl. No.: 58,051

[22] Filed: Jul. 16, 1979

[51] Int. Cl.[3] ..... B65G 69/06

[52] U.S. Cl. ..... 222/1; 222/195; 366/106; 406/85

[58] Field of Search ..... 222/1, 195; 366/3, 101, 366/106, 107; 406/85, 137

[56] References Cited

U.S. PATENT DOCUMENTS

| | | | |
|---|---|---|---|
| 2,353,346 | 7/1944 | Logan | 222/195 X |
| 3,740,041 | 6/1973 | Jones | 222/195 X |
| 3,822,919 | 7/1974 | Strom | 406/85 X |
| 3,830,548 | 8/1974 | Sem | 222/161 X |
| 3,861,753 | 1/1975 | Lesk et al. | 222/195 X |

*Primary Examiner*—Robert J. Spar
*Assistant Examiner*—Fred A. Silverberg
*Attorney, Agent, or Firm*—Michael Kovac

[57] ABSTRACT

A storage bin activator device that directs a precise pattern of multiple instantaneous energy bursts of impact, aeration and sonic stimulation directly into bulk material within the storage bin to free same for discharge. Also disclosed is a method for restoring free flow or removing disruptive material in a storage or other containment vessel.

9 Claims, 8 Drawing Figures

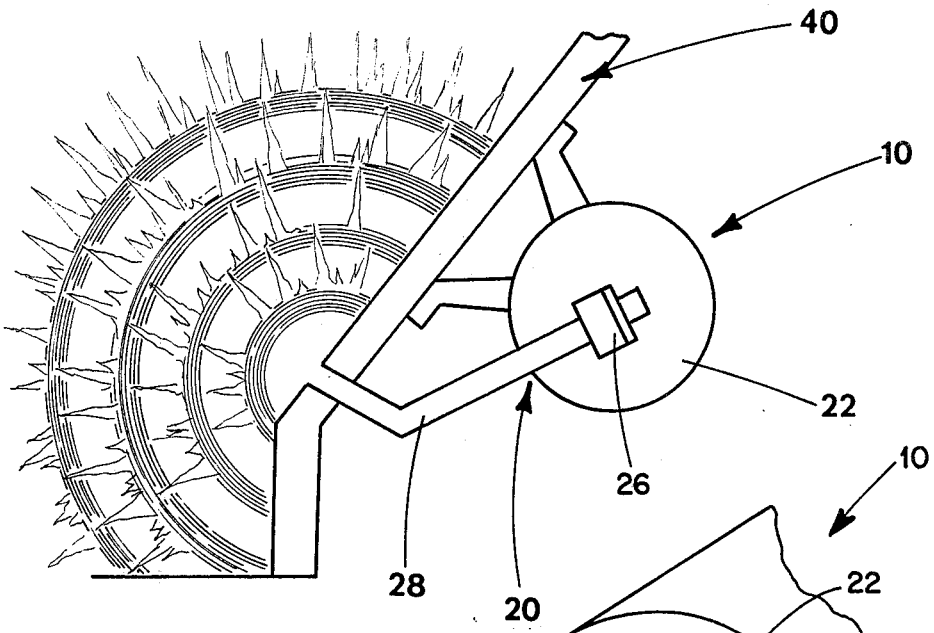
FIG. 2
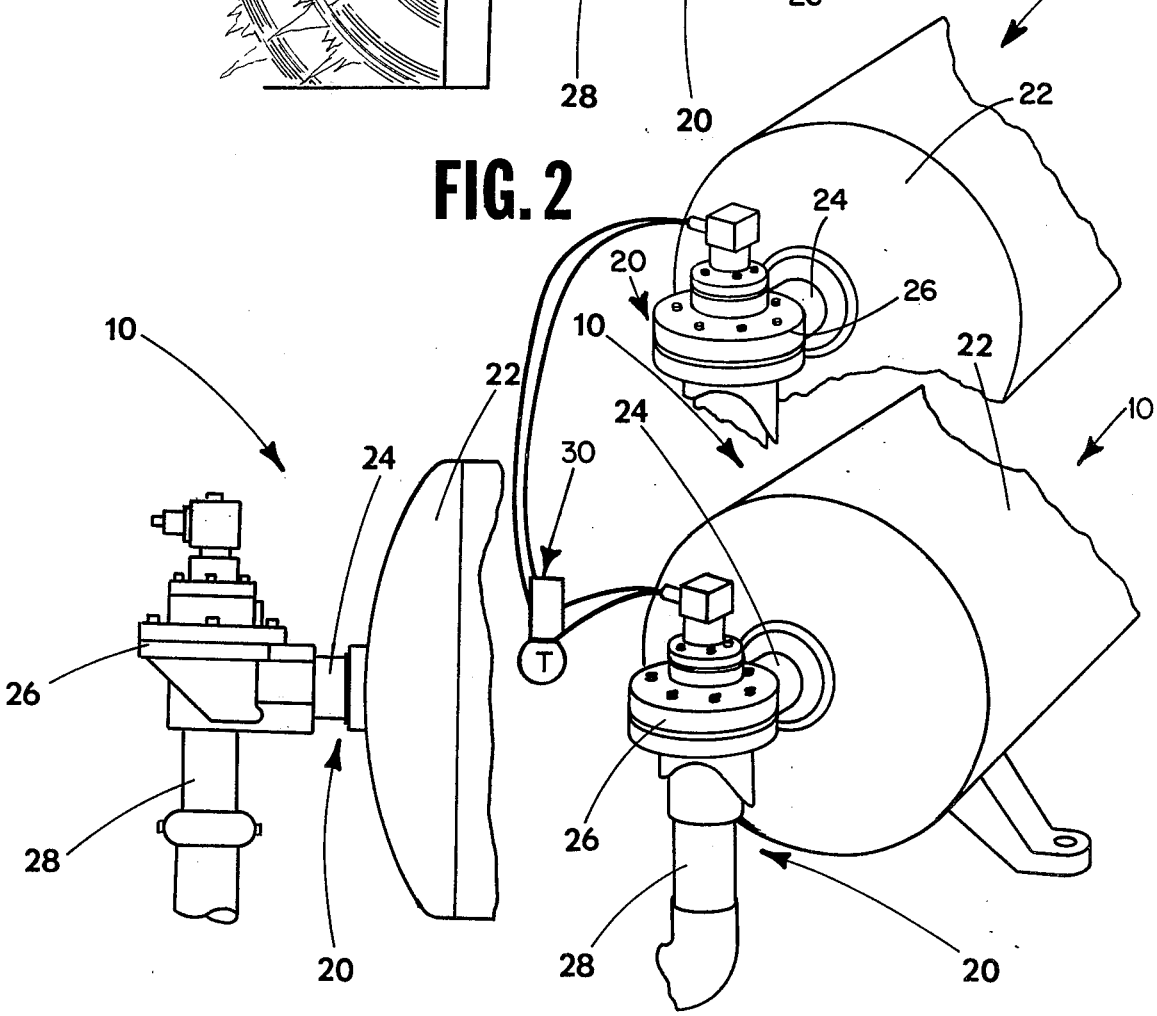
FIG. 3
FIG. 4

STORAGE BIN ACTIVATOR DEVICE AND METHOD FOR RESTORING BULK MATERIAL FREE FLOW

SUMMARY OF THE INVENTION

It is well known that storage bins, hoppers and other storage vessels for bulk granular materials have flow problems in the gravity feeding of such materials through a discharge opening at the lower end of such storage vessels. Common flow problems include, for example, material arching, bridging and clinging which can be caused by bin size and design, material flow characteristics, flow patterns (mass or funnel), temperature, humidity and other environmental and physical conditions. Other flow problems include the accumulation of materials in recessed channels, seal areas or surfaces and the like which, by their presence, cause interference with normal operation.

Various types of apparatus and methods have been employed including vibrator and other heavy impact devices which operate on the walls of the storage containers as well as devices which direct compressed air into the storage chamber in an attempt to break-up the material for easy flow. It has been found that devices of the last mentioned type are not only more effective, but also reduce wear and tear on hopper walls and other equipment, thus resulting in longer equipment life, less down time and reduced maintenance. Examples of such prior art devices are shown in U.S. Pat. Nos. 2,171,398; 3,249,263; 3,861,753; and 4,067,623.

The present invention is directed to devices of the last mentioned type, except that as compared with known prior art devices of this type, the present invention through adjustable multiple instantaneous bursts (usually less than one second) clears materials lodged in storage containers to induce free flow of the material through the discharge opening. All other prior art devices utilize compressed air over much longer periods or single blasts; however, for the reasons which will be discussed herein, such devices are not as effective as the multiple instantaneous energy burst concept of the present invention.

Accordingly, it is an object of the present invention to provide a storage bin activator device which instantaneously dislodges material arching, bridging, clinging and other flow problems to induce rapid and immediate free flow of such material through the discharge opening of the storage bin or container.

A further object of the present invention is to effectively remove disruptive materials which accumulate in recessed channels, seal areas or surfaces to cause interference with another function or process.

Another object of the present invention is to provide a method to restore the free flow of bulk granular material through a discharge opening in a storage bin or container by the use of multiple instantaneous energy bursts, as disclosed herein.

These and other objects and advantages of the present invention are achieved by providing a storage bin activator device and method to restore the free flow of material through a discharge opening in the storage bin, comprising means for or the step of introducing multiple instantaneous energy bursts of impact, aeration and sonic stimulation directly into the bulk material to induce free flow thereof through said discharge opening. Further, by the objects stated herein, the present invention utilizes the multiple instantaneous energy bursts for the removal of disruptive materials from unwanted areas which cause interference with normal operation.

BRIEF DESCRIPTION OF THE DRAWINGS

FIG. 2 is an enlarged in size fragmentary schematic side elevational view, partly in section, showing one preferred manner of mounting each storage bin activator device on a storage bin, and further showing the theoritical multiple instantaneous energy burst pattern (adjustable) obtainable from each injector;

FIG. 3 is a fragmentary side elevational view of the injector means comprising one of the components of the storage bin activator device of the present invention; and FIG. 4 is a fragmentary perspective view of the injector and programmer means comprising the storage bin activator device of the present invention.

DESCRIPTION OF THE PREFERRED EMBODIMENTS

In accordance with the present invention, bulk granular materials that arch, bridge, cling or rathole in storage, transportation, or surge vessels, including recesses thereof, are activated into freely moving particles by responding to a programmed energy release acting directly into the bulk material in the form of multiple instantaneous energy bursts as pulses of compressed gas, i.e., air. The energy bursts or pulses are preferably released at the desired field adjustable rate or frequency to which the bulk material is most responsive in order to achieve maximum stimulation. As a result, bulk material free flow is immediately restored to permit escape from the discharge opening of a storage bin or vessel. The multiple instantaneous energy burst pattern also effectively removes disruptive materials from recessed channels, seal areas or surfaces that interfere with normal operation.

Figure 1:
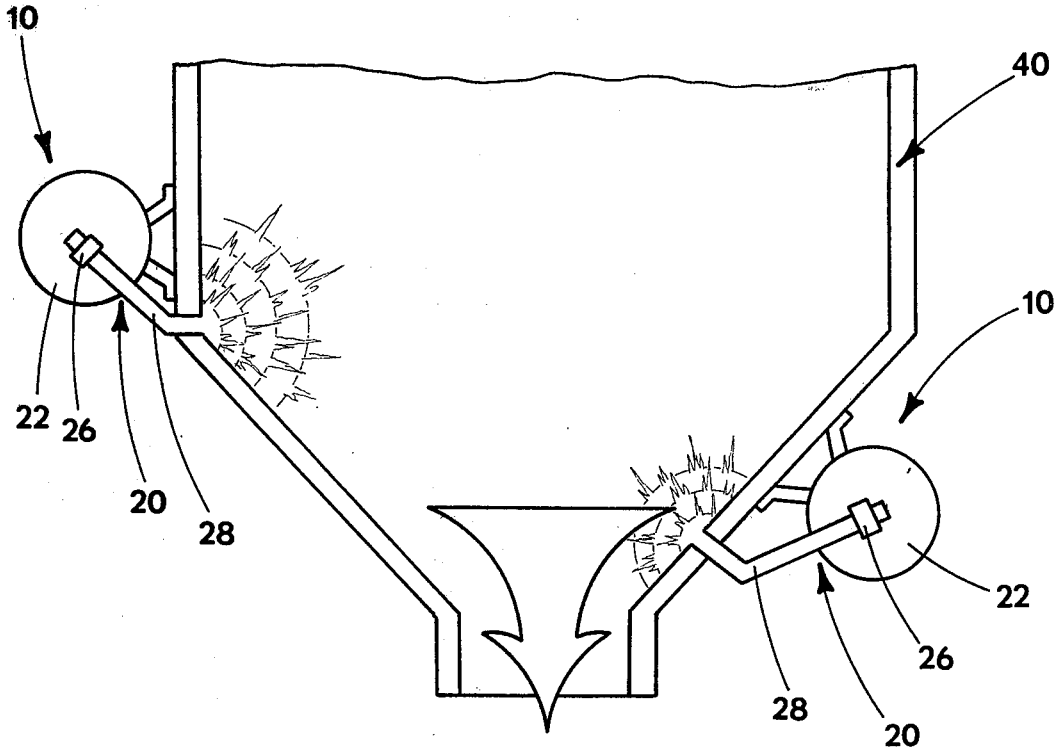
FIG. 1 is a fragmentary schematic side elevational view, partly in section, of a storage bin on which are mounted two storage bin activator devices which are constructed in accordance with the present invention.

Referring more particularly to the drawings, it will be seen that the storage bin activator device 10 of the present invention includes two basic components, namely an injector means 20 and a programmer means 30. The injector means 20 includes a compressed gas storage tank 22 which is connected through nipple and pipe assemblies 24 to an electrically operated valve 26 which is mounted at one end of the compressed gas storage tank 22. The electrically operated valve 26 connects the compressed gas storage tank 22 to the storage bin or vessel 40 by way of the pipe union and elbow assemblies 28 which have the free end thereof inserted into the storage bin or vessel 40, as shown in FIGS. 1-2. It will be noted that the arrangement of the compressed gas storage tank 22, electrically operated valve 26 and other aforementioned components of the injector means 20 permits close mounting thereof relative to the storage bin or vessel 40 in order to allow the multiple energy bursts from the injector means 20 to effectively act within the short allotted time on the bulk material with minimum system losses.

The electrically operated valve 26, i.e., solenoid controlled or the like, is designed to operate at the speeds established by the programmer means 30.

As discussed below, the programmer means 30 is designed to emit electrical signals in the approximate range of 20 to 100 milliseconds. Therefore, the electrically operated valve must be capable of responding from a mechanically open position to close position in order to allow only the prescribed amount of energy to pass from the storage vessel, with the balance of energy available for subsequent pulses, to establish the predetermined pulsing pattern.

The programmer means 30 is a field adjustable unit that emits electrical signals in the 20 to 100 millisecond range to control the injector means. Each programmer means 30 has any number of channels of output, with the number practical for today's needs being from one to six channels. Along with the multiple output channels, the programmer has timer means to control the time and duration of the electrical signals. Thus, the programmer means 30 controls the number of electrical signal pulses per channel, the number of active channels, the total on and off time per channel, the time for subsequent channels to activate, the time to repeat the sequence of operations and the time between initiating complete programs.

As can be seen in FIG. 4 of the drawings, the programmer means 30 has timer means T associated therewith, and both are electrically connected through multiple channels of electrical output, as shown, for operating multiple bin activator devices 10 on prescribed timing cycles, as pre-set by the programmer means 30.

The program selected dictates the exact sequence of energy bursts into the bulk material and is field adjusted to the preferred sequence which causes the material to respond in the most sympathetic response to the action of the injector means 20. The selection of a program will dictate how the energy bursts are directed into the bulk material in any one of the following ways:

(1) A clockwise travelling energy wave;

(2) A counter-clockwise travelling energy wave;

(3) Alternate releases from opposite walls of a vessel;

(4) Alternate releases from two injectors at the same location;

(5) All injectors operation simultaneously; or (6) Any combination of the above.

The programmer means 30 is field adjusted to locate a frequency to which the bulk material in the storage bin or vessel 40 will be naturally responsive, whether it be the preferred natural frequency of the bulk material, or some lesser or multiple of the natural frequency which causes bin activation. In some cases, the natural frequency of the material may be so different from the available pattern that the burst pattern cannot be adjusted; therefore, the bulk material movement will respond solely to the instrument of the pulse pattern. Where possible the natural frequency of the bulk material is preferred since it will maximize energy burst effectiveness.

The selected program is field adjusted to release only the number of energy bursts or pulses per injection which induces free flow. When the free flow is induced, the storage bin activator device 10 is then set for an at rest position until material flow interruption is detected. Then, the program is cycled again or it may be set to activate on a time interval basis determined by experience to prevent an arched, bridged or rathole situation before they can be established. With most materials, the storage bin activator device 10 is needed only to start the flow of materials from an at rest condition since when material flows, there is a natural aeration. Thus, it becomes necessary to activate the storage bin activator device 10 only when the material flow is stopped or when removal of the bulk material is at a rate which permits restructuring of a blockage (arching, bridging, clinging or rathole condition) by the material itself. In the latter case, the storage bin activator device 10 can be programmed on a time interval to prevent the blockage before it can be established.

Figures 1A, 1B, 1C, 1D:
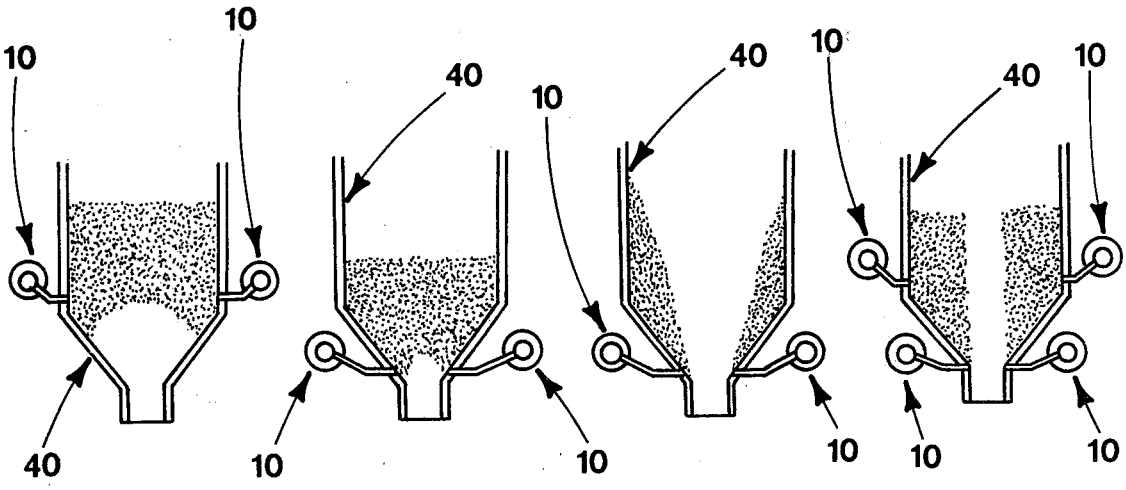
FIG. 1A is a reduced in size fragmentary schematic side elevational view, partly in section, showing one preferred mounting of two storage bin activator devices on a storage bin to prevent arching flow problems.
FIG. 1B is a reduced in size fragmentary schematic side elevational view, partly in section, showing one preferred mounting of two storage bin activator devices on a storage bin to prevent bridging flow problems.
FIG. 1C is a reduced in size fragmentary schematic side elevational view, partly in section, showing one preferred mounting of two storage bin activator devices on a storage bin to prevent clinging flow problems.
FIG. 1D is a reduced in size fragmentary schematic side elevational view, partly in section, showing one preferred mounting of a plurality of storage bin activator devices on a storage bin to prevent piping or rathole problems.

The common flow problems are those of arching (see FIG. 1A); briging (see FIG. 1B); clinging (see FIG. 1C) and rathole or piping (see FIG. 1D). In each of these figures is also shown the desired positioning and arrangement of the storage bin activator devices 10 to eliminate these common flow problems. Also, while not shown in the drawings, a pulse pattern, as described herein, which is directed along pipes, recessed channels, seal areas and other areas where material retention or build-up is undesirable can effectively remove the disruptive materials from such areas.

The following general description of operation is given in order to provide a better understanding of what is believed to be taken place during the multiple instantaneous energy burst release.

In the short instant (20 to 100 milliseconds) of the compressed gas burst, each burst or injection of compressed gas acts directly on the particles it contacts and causes motion thereof in line with the movement and expansion of air. Simultaneously, with the initial movement of the materials, there is aeration of the materials from the expansion of the compressed gas. The programmer means 30 are set so that before the moving particles from the initial burst comes to rest, a second energy release of compressed gas is injected into the bulk material. Since the moving particles from the initial burst are still moving, and the activated area is at an elevated pressure, the second burst imparts a greater movement, disruption or aeration force because it is acting on or amplifying the initially moved particles. Each subsequent energy release is programmed to act on materials that are not at rest, but rather have kinetic energy in their movement, such that the subsequent energy releases, even those of lesser energy levels than previous bursts, are move effective than the previous bursts due to the amplification effect. The energy level of the particles in motion increases with each burst or pulse to a higher level, and this higher motion is transmitted to more and more particles with impact and aeration stimulation extended into the entire vessel. The energy bursts or pulses are released at a field adjustable rate or frequency that is most responsive to the bulk material in order to achieve sonic stimulation as well. The multiple instantaneous energy releases of impact, aeration and sonic stimulation act, in concert with one another, directly on the material to immediately induce free flow thereof. When the proper program, location and number of storage bin activator devices 10 have been selected, an entire storage vessel can be totally activated to induce free flow in from less than one second to a few seconds. Disruptive materials in pipes, recessed channels, seal areas and other areas are also similarly removed within this time frame.

It will be apparent that the instantaneous injection of the above discussed forms of stimulation/activation energy (impact, aeration and sonic) which are concentrated in and on the materials can be adjusted to supply the precise amount of energy to achieve total stimulation through maximum efficiency. Maximum stimulation with minimum energy depends on the combination of the compressed gas pressure level, the frequence of the bursts or pulses, the pressure profile of the energy bursts, the location and number of injector means, and the field tuning of the programmer means.

The material activation forms of impact, aeration and sonic stimulation are somewhat illustrated in FIGS. 1 and 2 of the drawings where a plurality of closely grouped concentric rings are depicted as the impact force, with the aeration and sonic stimulation forces being represented by the graph-like profile illustrations.

From the foregoing, it will be appreciated that the storage bin activator device and method of the present invention quickly and efficiently restores free flow to bulk material in a storage vessel or removes disruptive materials from other containment vessels. Further, with selection, control and adjustment of the components of the system, maximum effectiveness can be achieved with minimum time and energy expended. The overall result is a device and method which far exceeds the operation and effectiveness of all other known prior art devices and methods.

What is claimed is:

1. A material activator device to initiate the free flow of material or remove disruptive materials from a containment vessel, comprising at least one injector means for introducing sequential energy bursts of compressed gas into the containment vessel, programmer means for regulating the length of the energy bursts, the intervals between the energy bursts and the number of the energy bursts in each sequential burst pattern, each said length of the energy bursts and the intervals between the energy bursts being in an adjustable programmer signal range of 20 to 100 milliseconds establishing said sequential burst pattern of multiple linked sequential energy bursts which act on moving particles of material before the moving particles come to rest, said programmer means also establishing different intervals than the intervals between the energy bursts so as to create separated sequential burst patterns, whereby the sequential energy bursts of compressed gas in each sequential burst pattern provide multiple linked impact, aeration and vibration forces at or near sonic frequency to induce free flow of material or dislodge disruptive materials in the containment vessel.

2. The material activator device as defined in claim 1 wherein the injector means comprises an electrically operated valve means controlled by said programmer means, and compressed gas storage means controlled by said electrically operated valve.

3. The material activator device as defined in claim 2 wherein both said electrically operated valve means and compressed gas storage means are mounted immediately adjacent to one another and to said containment vessel in order to maximize response time with minimum system losses.

4. The material activator device as defined in claim 1 wherein the programmer means has multiple channels of electrical signal output and timer means, and said programmer means controls the number of electrical signal pulses per channel, the total on and off time of the signal pulses, and the time between initiating complete programs.

5. The material activator device as defined in claim 1 wherein the programmer means has multiple channels of output, and the sequential burst pattern from at least one channel of output is different from the sequential burst pattern of another channel of output.

6. The material activator device as defined in claim 5 wherein the sequential burst pattern from at least one channel of output operates during the separated intervals between sequential burst patterns of another channel of output.

7. The material activator device as defined in claim 1 wherein the different intervals between separated sequential burst patterns are of the same duration.

8. The material activator device as defined in claim 1 wherein there are a plurality of injector means, each of which are operated and controlled by said programmer means.

9. A method for initiating free flow or removing disruptive materials from a containment vessel, comprising the steps of introducing sequential energy bursts of compressed gas into the containment vessel, regulating the length of the energy bursts, the intervals between the energy bursts and the number of energy bursts in each sequential burst pattern, each said length of energy bursts and the intervals between the energy bursts operable in an adjustable programmer signal range of 20 to 100 milliseconds establishing said sequential burst pattern of linked sequential energy bursts which act on moving particles of material before the moving particles come to rest, each said sequential energy burst pattern also being separated from one another by a different interval than the interval between the energy bursts, whereby the sequential energy bursts of compressed gas in each sequential burst pattern provide multiple linked impact, aeration and vibration forces at or near sonic frequency to induce free flow of material or dislodge disruptive materials in the containment vessel.

* * * * *